US005457841A

United States Patent [19]

Minton

[11] Patent Number: 5,457,841

[45] Date of Patent: Oct. 17, 1995

[54] CLEANING PIG FOR PIPELINE OF VARYING DIAMETER

[75] Inventor: Joseph R. Minton, Saginaw, Tex.

[73] Assignee: Continental Emsco Company, Garland, Tex.

[21] Appl. No.: 323,448

[22] Filed: Oct. 13, 1994

[51] Int. Cl.[6] ..... B08B 9/04

[52] U.S. Cl. ..... 15/104.061

[58] Field of Search ..... 15/104.061, 104.062, 15/104.063, 3.5, 3.51; 137/268

[56] References Cited

U.S. PATENT DOCUMENTS

| | | | |
|---|---|---|---|
| 2,906,650 | 9/1959 | Wheaton | 134/8 |
| 3,277,508 | 10/1966 | Knapp | 15/104.06 |
| 3,473,572 | 10/1969 | Nielson et al. | 137/802 |
| 3,538,531 | 11/1970 | Knapp et al. | 15/104.061 |
| 3,543,324 | 12/1970 | Knapp et al. | 15/104.061 |
| 3,604,041 | 9/1971 | Ver Nooy | 15/104.061 |
| 3,619,844 | 11/1971 | Collins et al. | 15/104.061 |
| 3,725,968 | 4/1973 | Knapp et al. | 15/104.061 |
| 3,766,587 | 10/1973 | French | 15/104.061 |
| 3,857,132 | 12/1974 | Knapp et al. | 15/104.061 |
| 3,863,287 | 2/1975 | Knapp et al. | 15/104.061 |
| 3,879,790 | 4/1975 | Girard | 15/104.061 |
| 3,903,728 | 9/1975 | Matthews, Jr. | 73/40.5 R |
| 4,016,620 | 4/1977 | Powers | 15/104.061 |
| 4,069,535 | 1/1978 | Cato | 15/104.061 |
| 4,077,079 | 3/1978 | Knapp | 15/104.061 |
| 4,083,074 | 4/1978 | Curtis | 15/104.061 |
| 4,083,076 | 4/1978 | Girard | 15/104.061 |
| 4,122,575 | 10/1978 | Sagawa | 15/104.061 |
| 4,242,771 | 1/1981 | Knapp | 15/104.061 |
| 4,244,073 | 1/1981 | Sagawa | 15/104.061 |
| 4,275,475 | 6/1981 | Schwartz et al. | 15/104.061 |
| 4,365,379 | 12/1982 | Neff | 15/104.061 |
| 4,413,370 | 11/1983 | Payne et al. | 15/104.061 |
| 4,506,401 | 3/1985 | Knapp | 15/104.061 |
| 4,509,222 | 4/1985 | Knapp | 15/104.061 |
| 4,603,449 | 8/1986 | Knapp | 15/104.061 |
| 4,984,322 | 1/1991 | Cho et al. | 15/104.061 |
| 5,032,185 | 7/1991 | Knapp | 134/22.11 |
| 5,295,279 | 3/1994 | Cooper | 15/104.061 |

OTHER PUBLICATIONS

Continental Emsco Company product sales brochure, 1992, pp. 3–6 Maarklev Maribu, Zee Pipe Experience: Developing Pigs for 506–Mile Subsea Line, Pipeline Industry, International Edition, Aug., 1994, pp. 23–31.

F. H. Maloney Company product sales brochure for Flex Mag Pig, 1987 all pages.

F. H. Maloney Company product sales brochure for Scrapper Cups and Disks, 1988, all pages.

Maloney Pipeline product sales brochure for Pipeline pigs, 1982, all pages.

F. H. Maloney Company product sales brochure for Magnum Pigs, 1988, all pages.

Coulter Services product sales brochure for the Flex I Pig, Jun. 1, 1985, all pages.

(List continued on next page.)

*Primary Examiner*—Edward L. Roberts, Jr.
*Attorney, Agent, or Firm*—Arnold, White & Durkee

[57] ABSTRACT

A non-metallic pipeline cleaning pig for cleaning a variable diameter pipeline comprises an elongated cylindrical body, front and back cups coupled to the body, and a plurality of generally circular wiping discs coupled to the body between the cups. The wiping discs are disposed in pairs spaced apart from one another. Each disc has plurality of circumferentially spaced fingers respectively separated by a plurality of circumferentially spaced slots. Each finger has a peripheral surface of a given arc length. The number and configuration of the fingers and slots is chosen so that the sum of the arc lengths is approximately equal to the internal circumference of the smallest diameter pipe section encountered.

An abrasive may be applied to the fingers to enhance the cleaning action. In addition, cleaning solvent may be jetted from behind the pig to the internal surface of the pipeline in front of the pig.

27 Claims, 4 Drawing Sheets

OTHER PUBLICATIONS

Pipeline Dehydrators, Inc. product sales brochure for pigging products, 1982, pp. 7–11.

Pipeline Pigging Products, Inc. product sales brochure, 1989, all pages.

T. D. Williamson, Inc. product sales brochure for pipeline pigs and accessories, 1983, all pages.

Bruce Munden, Petroleum Engineering International, Oct. 1980, all pages.

CLEANING PIG FOR PIPELINE OF VARYING DIAMETER

BACKGROUND OF THE INVENTION

1. Field of the Invention

This invention relates to pipeline cleaning pigs. More particularly it relates to pipeline cleaning pigs having one or more slotted flexible discs.

2. Description of the Related Art

The buildup of coatings on the interior of surfaces of pipelines is a common problem in the chemical, petroleum, and water supply industries. Pipelines carrying petroleum products may sustain buildups of paraffin, asphaltene, or other substances which may adhere to the interior surface of the pipeline. If the buildup of the coating material remains unchecked, the flow capacity of the pipeline may be severely restricted.

For a number of years, pipeline operators have used pigs to remove undesirable coatings from the interior of pipelines. These prior art pigs typically comprise a metal body or mandrel that supports one or more flexible scraping discs, and/or cups. The discs are ordinarily made of some type of rubber or thin metal. There are several disadvantages associated with these prior art pigs. First, if the metal mandrel pig suffers a catastrophic failure while inside the pipeline, the metal fragments from the mandrel may become lodged in the wall of the pipeline or in valves or pipeline junctions, or they may damage downstream equipment such as pumps or sensors. The metal mandrel in combination rubber metal pigs presents a further disadvantage. In certain pipeline settings, it may be necessary for the pig to be able to pass through relatively extreme radius bends. In such extreme radius bends, the relatively rigid metal mandrel may prevent the pig from successfully navigating the bend. There are some metal mandrel pigs that have a universal joint in the mandrel that will enable the pig to pass a bend. However, the universal joints add costs, and present another mechanism that is subject failure within the pipeline.

Completely nonmetallic pigs do not suffer from the foregoing disadvantages. For example, if a nonmetallic pig suffers a catastrophic failure inside the pipeline, the rubber fragments will ordinarily degrade over time in the presence of the flowing fluid. In addition, a second pig may be sent through the pipeline to either destroy or dislodge the rubber fragments. While the nonmetallic pigs do not present the disadvantages associated with the metal mandrel pigs, they nevertheless present a further disadvantage, that becomes readily apparent in pipelines of variable internal diameter.

For ease of cleaning and maintenance, it is ordinarily desirable for a pipeline to have a constant internal diameter. However, there are many circumstances where two sections of pipeline, each having a different internal diameter, are joined together. In such circumstances, a pig having a given diameter may be satisfactory to clean the interior of one of the pipeline sections, but not the other. For example, the cleaning discs and/or cups on the all-rubber pig may not be sufficiently flexible to enable the pig to readily move from a relatively larger diameter pipe length to a relatively smaller diameter pipe. For those pigs that do have sufficiently flexible cleaning discs, there is the further risk that, as the pig encounters a reduced internal diameter pipe section, and the discs are folded backward, buckling may occur. As the discs buckle, the peripheral surfaces of the discs will have a tendency to form folds and ripples, not unlike the folds that form in a piece of cloth pressed through a gun barrel during cleaning. The buckling is a natural consequence of the overgauged discs being compressed into the undergauged internal diameter of the second section of pipe.

There is a further disadvantage associated with current pigs. The discs on current pigs ordinarily have smooth surfaces. However, there may be circumstances where the undesirable coating has become particularly hard and, therefore, resistant to removal by a smooth surfaced pig.

SUMMARY OF THE INVENTION

In aspect of the present invention, a pipeline pig adapted to pass through a pipeline having an internal surface, a first length having a first internal diameter, and a second length having a second internal diameter, comprises an elongate elastomeric body having a first end, a second end, and a longitudinal axis. A first cup is coupled to the first end and a second cup is coupled to the second end. The second cup has a rear surface. At least one pair of first and second elastomeric intermediate discs is coupled to the body between the first and second ends. Each of the first and second intermediate discs has first and second radii, and a plurality of circumferentially spaced fingers extending radially outward from the first radius to the second radius. Each of the fingers has a front surface and an arcuate peripheral surface. The arcuate peripheral surface has an arc length. The fingers have a first erect position when in the first length of pipeline, and a second bent position when in the second length of pipeline. The fingers are respectively separated from each other by a plurality of circumferentially spaced slots that extend radially inward from the second radius to the first radius. For each the pair of intermediate discs, the first intermediate disc is rotatably positioned relative to the second intermediate disc whereby the slots of one of the first or second intermediate discs are aligned with the fingers of the other of the first or second intermediate discs.

In another aspect of the present invention, a unitized construction, non-metallic, pig adapted to pass through a pipeline having an internal surface, a first length having a first internal diameter, and a second length having a second internal diameter, comprises an elongate elastomeric body having a first end, a second end, and a longitudinal axis. A first cup positioned at the first end. The first cup has a conical front surface. A second cup is positioned at the second end and has a rear surface. First, second, and third pairs of intermediate elastomeric discs are positioned between the first and second ends. Each of the intermediate discs has first and second radii, and a plurality of circumferentially spaced fingers extending radially outward from the first to the second radius. Each of the fingers has a front surface and an arcuate peripheral surface that has an arc length. Each of the fingers has a first width at the first radius and a second and larger width at the second radius. The fingers have a first erect position when in the first length of pipeline, and a second bent position when in the second length of pipeline. The fingers are respectively separated from each other by a plurality of circumferentially spaced slots that extend radially inward from the second radius to the first radius. For each of the pair of elastomeric intermediate discs, the first of the intermediate discs is rotatably positioned relative to the second of the intermediate discs whereby the slots of one of the first or second intermediate discs are aligned with the fingers of the other of the first or second intermediate discs.

DESCRIPTION OF THE DRAWINGS

Advantages of the invention will become apparent upon reading the following detailed description and references to the drawings in which.

DESCRIPTION OF THE PREFERRED EMBODIMENTS

Figure 1:
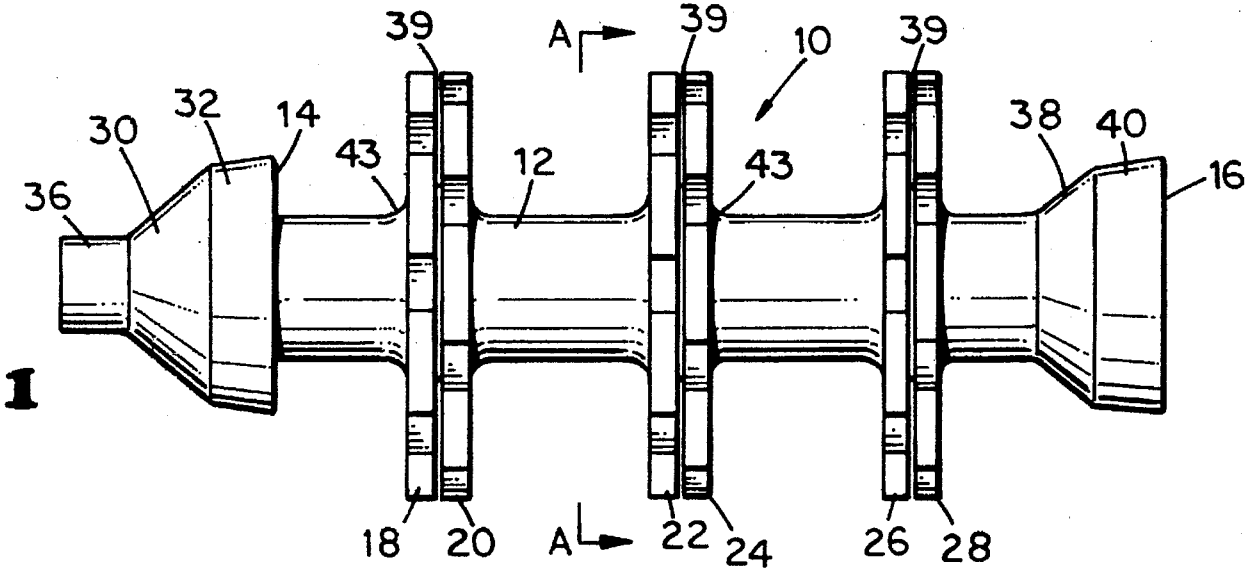
FIG. 1 depicts the pig, illustrated in a front view.

Referring now to the drawings and, in particular, to FIG. 1, there is shown a pipeline pig 10. The pig 10 generally comprises an elongated cylindrical body 12, a front cup 14, a back cup 16, and intermediate wiping discs 18, 20, 22, 24, 26, and 28, that are connected to the body between the front cup 14 and the back cup 16. The longitudinal axis of the body 12 is indicated generally at 13.

Figure 2:
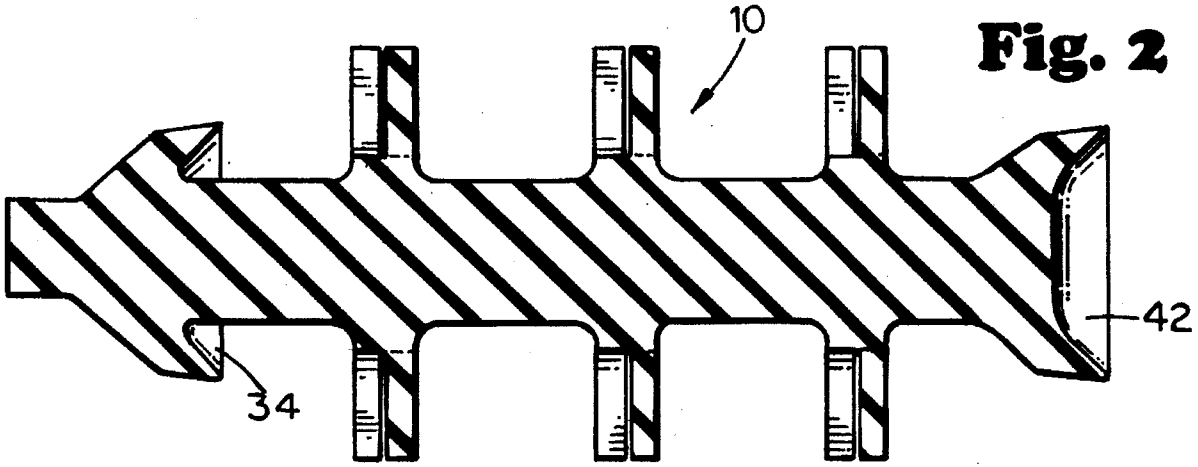
FIG. 2 is a sectional view of FIG. 1.

FIG. 2 is a half section of pig 10. Front cup 14 is formed from a frustrum portion 30 integrally connected to a frustrum portion 32. Front cup 14 has an interior frustro-conical surface 34. Frustro-conical surface 34 provides a thrust surface for fluid pressure to act upon to propel pig 10 through a pipeline. A generally cylindrical nipple 36 is connected to the front of frustrum 30. The size and configuration of nipple 36 is not critical, and in fact, nipple 36 may be eliminated altogether. In other words, frustrum portion 32 may terminate in a planar surface, a conical configuration, or any other number of configurations. Front cup 14 is generally frustro-conically configured to facilitate the easy insertion of pig 10 into a pipeline. However, front cup 14 need not be frustro-conically configured. Any number of tapered configurations are suitable, for example, a parabolic or elliptical surface would be suitable.

Back cup 16 is formed from a frustrum 38 integrally connected to a frustrum 40. Frustrum 38 is coupled to body 12. Frustrum 40 has an internal frustro-conical surface 42. Frustro surface 42 provides a thrust surface for fluid pressure to act upon to propel pig 10 through a pipeline. As with front cup 14, the back cup 16 need not have a generally frustro exterior profile nor a frustro interior surface 42, but may alternatively have any number of generally tapered profiles such as elliptical or parabolic.

Figure 7:
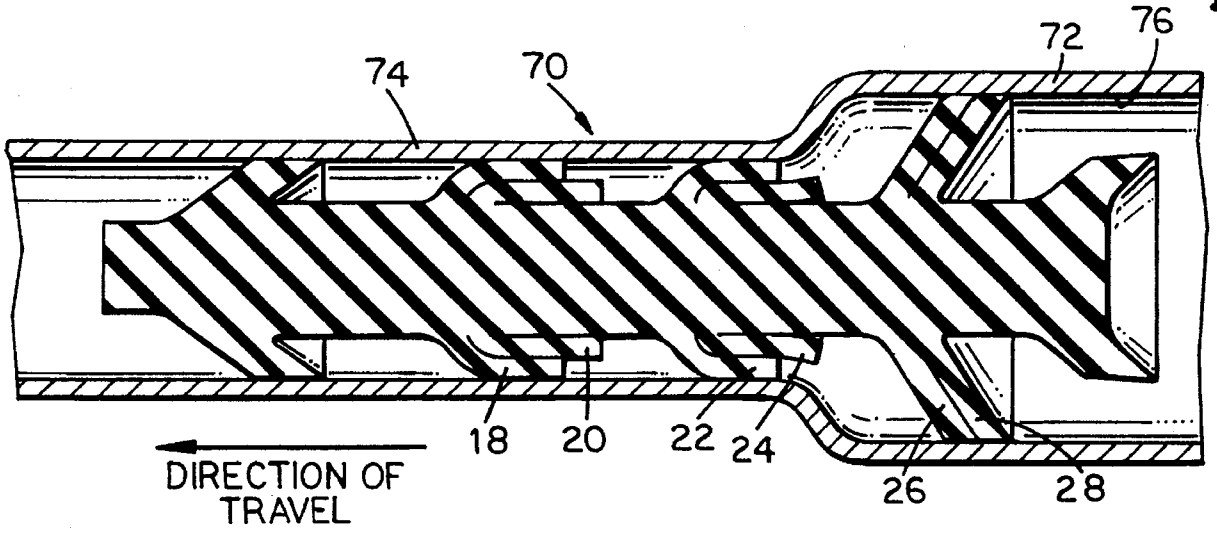
FIG. 7 depicts the pig inserted in a reducing diameter pipeline, illustrated in a sectional view.

The discs 18, 20, 22, 24, 26 and 28 are generally circular in shape and arranged in pairs, 18 and 20, 22 and 24 and 26 and 28. The pairs of discs 18, 20, 22, 24, 26 and 28 should be spaced apart so that when adjacent discs from two adjacent pairs of discs bend, there will not be physical contact between them which might interfere with their ability to bend properly. For example, if pig 10 encounters a reduced diameter pipe section, as is shown in FIG. 7, the discs 18, 20, 22, 24, 26 and 28 will all bend away from the direction of travel. It is important that disc 20 be positioned on the body 12 a sufficient distance away from the disc 22, so that when discs 20 and 22 bend, the disc 22 will not impede the ability of the disc 20 to fully bend. It is also important that disc 28 be placed on the body 12 a sufficient distance away from frustrum 38, so that frustrum 38 does not interfere with the ability of disc 28 to fully bend.

There is a gap 39 separating the adjacent discs of each pair of discs 18 and 20, 22 and 24, and 26 and 28. The gap 39 ensures that there can be relative shearing movement between the discs 20 and 22 as they bend during movement of the pig 10 in a pipeline.

The minimum preferable width of the gap 39 will depend on how the discs 18, 20, 22, 24, 26 and 28 are joined to the body 12. If the body 12 and the discs 18, 20, 22, 24, 26 and 28 are molded separately and thereafter coupled together, the width of the gap 39 may be essentially zero. However, if the body 12 and the discs 18, 20, 22, 24, 26 and 28 are integrally molded together, the gap 39 must be wide enough to accommodate a shim that is placed in the mold to form the gap 39. In one preferred embodiment utilizing integrally molding, the width of the gap 39 is between 0.020 and 0.030 inches.

The maximum preferable width of the gap 39 is limited by the sealing capability of each pair of discs 18, 20, 22, 24, 26 and 28. If the gap 39 between to adjacent discs, for example, 22 and 24, is too wide, the discs 22 and 24 may not be able to effectively seal against the internal surface of a pipeline. For a preferred embodiment of the pig 10 adapted to clean a pipeline that has an internal diameter variable between 4.00 inches and 2.5 inches, the maximum preferred width of the gap 39 is 0.0625 inches.

All of the components of the pig 10 are preferably manufactured from polyurethane rubber with a durometer of between 60 and 80 inclusive. Polyurethane is a preferred material because it is readily moldable, either by pouring or injection molding, and because it is capable of extreme elastic deformation. The capability of elastic deformation enables the body 12 to readily bend, thereby allowing the pig 10 to pass extreme radii in a pipeline without becoming lodged. Other elastomeric materials, such as nitrile and neoprene rubbers, are suitable alternatives.

In the drawings, the discs 18, 20, 22, 24, 26, and 28, and the front and back cups 14 and 16 are depicted as being integrally coupled to the body 12. This would be the case when the entire pig 10 is molded as a single unit. However, it should be understood that the components of the pig 10 may be separately molded and later joined by a second molding process or by applying a suitable adhesive to the body 12 and the discs 20, 22, 24, 26, and 28, and the front and back cups 14 and 16.

The portion of the body 12 disposed to either side a each pair of discs, 18 and 20, 22 and 24, and 26 and 28, has a generally outward flare so as to form arcuate fillet surfaces 43. The fillet surfaces 43 reduce the potential for a stress riser at the interface between each pair of discs 18 and 20, 22 and 24, and 26 and 28, and the body 12.

Figure 3:
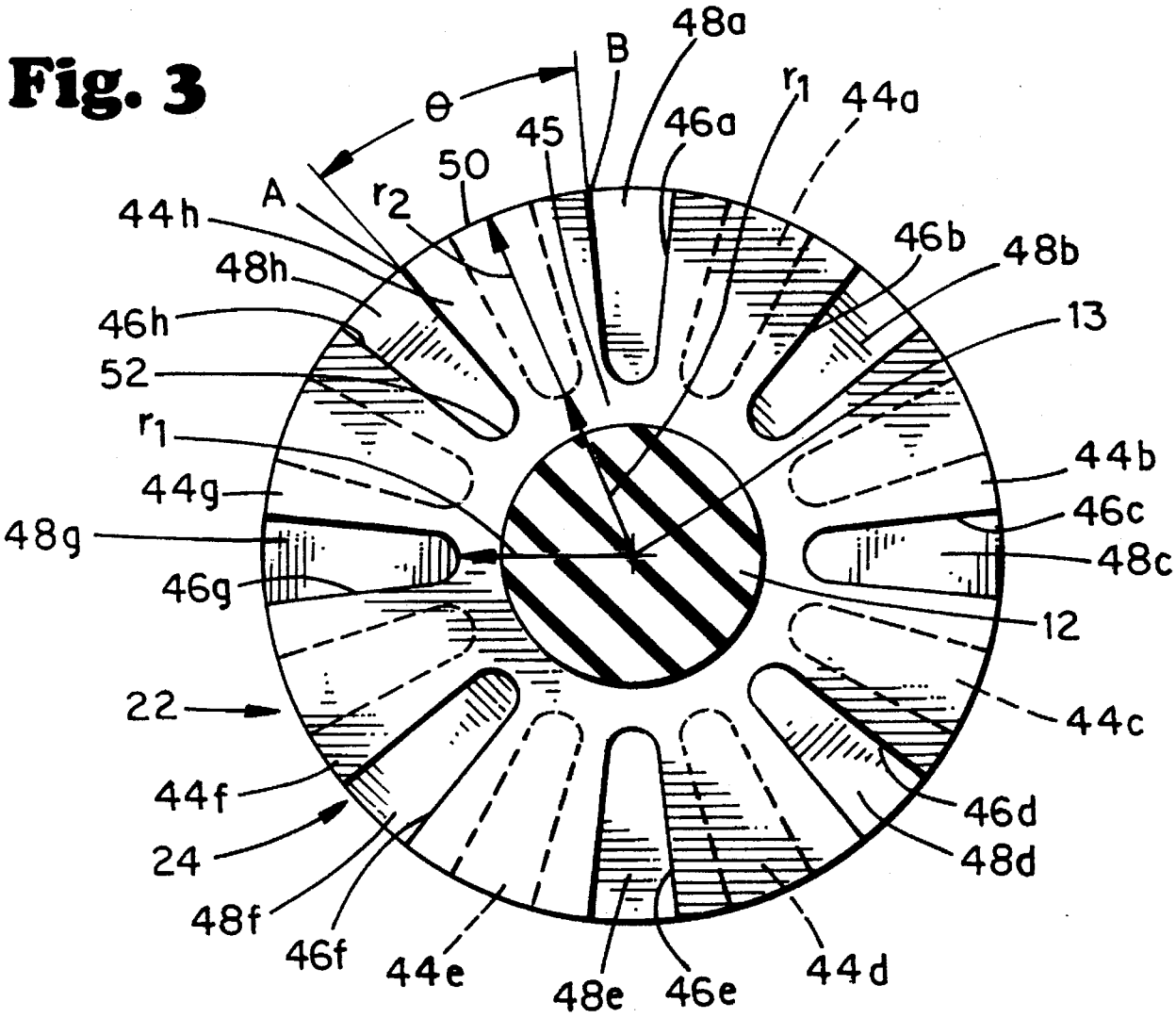
FIG. 3 depicts a sectional view of FIG. 1 taken at section A—A.

FIG. 3 is a section view of FIG. 1 taken at section A—A, and shows a more detailed view of discs 22 and 24. The following description of discs 22 and 24 is also applicable to discs 18, 20, 26, and 28. Disc 22 comprises eight circumferentially spaced fingers 44*a–h*. The fingers 44*a–h* are separated by eight circumferentially spaced slots 46*a–h*. There are identical slots shown in phantom and unnumbered on disc 24. The disc 24 also has eight fingers 48*a–h*. As explained in more detail below, the disc 24 is positioned at an offset from disc 22 so that the approximate midline of fingers 48*a–h* or the disc 22 are in alignment with the approximate midline of slots 46*a–h* on the disc 22.

This interrelationship between the fingers 44*a–h* and the slots 46*a–h* is important for two reasons. First, the overlap provides a seal to restrict the flow of fluid pass the discs 22 and 24 that is adequate to maintain back pressure on the pig 10, that is sufficient to move the pig 10 in a relatively larger diameter section of pipeline. It should be understood that in a relatively larger diameter section of pipeline, the discs 18, 20, 22, 24, 26, and 28 provide the primary thrust surfaces. Second, the overlap is necessary to ensure that the entire internal circumference of the pipeline is swathed by the fingers 44*a–h* when the pig 10 is passing through a relatively larger diameter pipeline section.

The following discussion of finger 44*h* and slot 48*h* is exemplary of all of the fingers and slots on the pig 10. The finger 44*h* extends radially outward from a root designated generally by radius $r_1$, terminating in an arcuate surface 50 at the radius $r_2$. The finger 44*h* has a generally outward taper. The amount of taper is, of course a function of, among other things, the angle θ.

The slot extends radially outward from a point indicated generally by radius $r_1$ to a point indicated generally by radius $r_2$. The slot 46*h* has a generally outward taper that is a function of angle θ. The bottom 52 of slot 46*h* is depicted as having rounded sidewalls, principally to avoid the potential for stress risers that might be associated with sharp corners. However, the bottom 52 of the slot 46*h* may alternatively be squared, or V-shaped.

As noted above, the number and configuration of the fingers 44*a–h* and the slots 46*a–h* is a matter of discretion on the part of the designer. However, in order to insure adequate cleansing of the interior of a pipeline, it is desirable for the fingers 44*a–h* to contact approximately 100% of the internal circumference of the pipeline. This may be easily accomplished with non-tapered or rectangular shaped fingers and slots in a continuous internal diameter pipeline where there will be little if any bending of the fingers. However, in a pipeline where the pig 10 will encounter a reduced diameter section, the number and configuration of the fingers 44*a–h* becomes more important. In order to insure that the discs 22 and 24 maintain contact with approximately 100% of the internal circumference of a reduced diameter pipeline section, e.g. without buckling, the dimensions of a given finger should be tailored carefully.

Referring still to FIG. 3, the finger 44*h* has a perimeter length indicated by arc $\widehat{AB}$. Mathematically, arc $\widehat{AB}$ is defined by the equation: $r_2 \times \theta$. Proper coverage of the internal circumference of a reduced diameter section of a pipeline may be maintained if the sum of the arc lengths of the fingers 44*a–h* is approximately equal to the internal circumference of the reduced diameter pipe section. Mathematically, the relationship is described as follows:

$$\sum_{1}^{n} r_2\theta \cong \pi(\phi_{int}) \qquad \text{Equation No. 1}$$

where n=the number of fingers and $\phi_{int}$=the internal diameter of the pipe.

The following values illustrate the calculations. In a preferred embodiment of disc 22 shown in FIG. 3 that is suitable for use in a pipeline that has an internal diameter that varies between 4 inches and 2½ inches, the disc 22 preferably has the following pertinent dimensions and parameters: disc diameter=4.160 inches ($2 \times r_2$), θ=0.520 radians (approximately 29.9°), n=8. The total of the arc lengths of the fingers 44*a–h* is given by the left side of the equation no. 1:

$$\sum_{1}^{8} \frac{(4.160 \text{ inches})}{2} (0.50 \text{ radians}) = 8.65 \text{ inches} \qquad \text{Equation No. 2}$$

The total of the lengths 8.65 inches is approximately equal to the internal circumference of the smaller internal diameter, which is given by the right side of equation no. 1 or π (2.5 inches) or 7.85 inches. Note, however, that the sum of the arc lengths is slightly greater than the internal circumference of the pipe section. This is desirable, since there will be some shortening of the arc lengths of the fingers 44*a–h* as the fingers are compressed together in the smaller diameter pipe section. The result of the approximately matched circumferences is minimal or no buckling in the discs 18, 20, 22, 24, 26, and 28.

When the pig 10 encounters a reduced diameter section of a pipeline, there may be significant bending of the fingers 44*a–h*. It is conceivable that the bending may approach 90°. In such circumstances, it is desirable that the inner diameter of the disc 22 be somewhat less than the inner diameter of the reduced diameter pipe section when the fingers 44*a–h* are fully bent so that the pig will translate freely through the reduced diameter pipe section. To provide a buffer between the diameter of the disc 22 with full finger bending, and the internal diameter of the reduced diameter pipe section, it is preferred that the inner diameter, or $2(r_1)$, of the disc 22, be between 0 and ½ inch less than the internal diameter of the reduced diameter pipe section. For example, for the disc 22 shown in FIG. 3, assume that the smallest internal diameter pipe section to be encountered has an internal diameter of 2.5 inches. The depth of co-linear slots 46*a* and 46*c* should be such that the distance $2 \times R_1$ is≦2.5 inches and≧2.00 inches.

Figure 4:
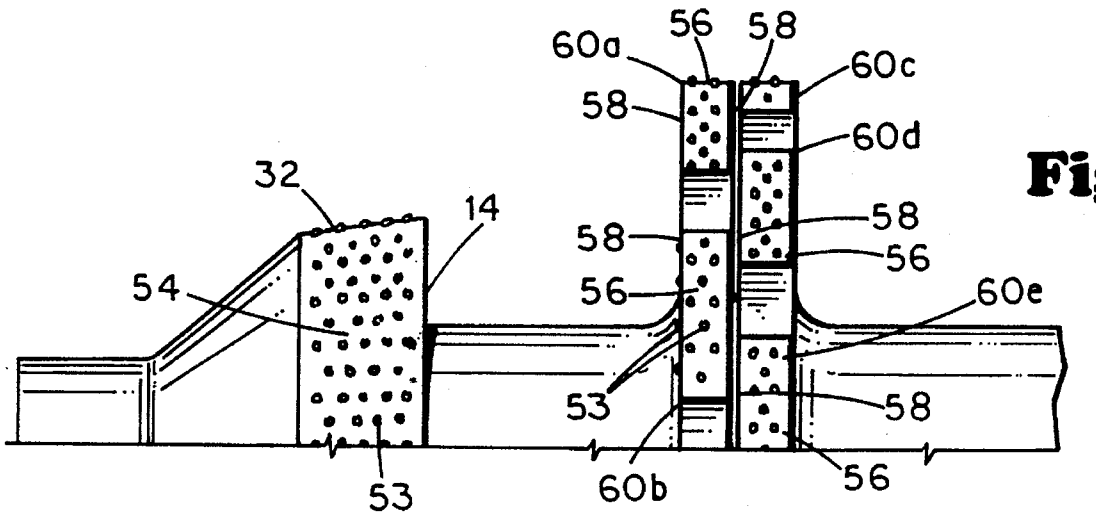
FIG. 4 depicts a portion of the pig front cup and discs, illustrated in a partial cutaway view.

Some pipelines may contain coatings that are particularly difficult to remove from the interior surface of the pipeline. In such circumstances, it may be desirable to apply an abrasive material to the fingers 44*a–h*. FIG. 4 shows a partial cutaway view of a portion of the pig 10, including the front cup 14 and the discs 18 and 20. In the preferred embodiment shown in FIG. 4, an abrasive material 53 is partially impregnated in peripheral surface 54 of the frustrum 32. The abrasive material 53 is also partially impregnated into the peripheral surfaces 56 and the leading edge surfaces 58 of the fingers 60*a–e*. The abrasive material 53 is molded directly into the elastomeric material from which the pig 10 is fabricated.

Figure 5A:
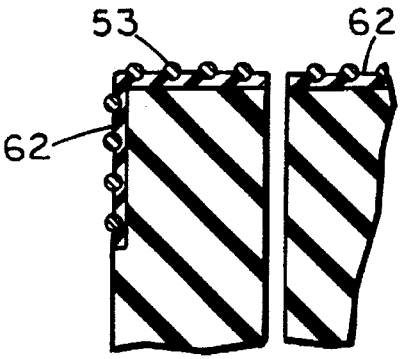
FIG. 5A depicts a preferred embodiment of an adhesive material mounted on the discs, illustrated in a partial sectional view.
Figure 5:
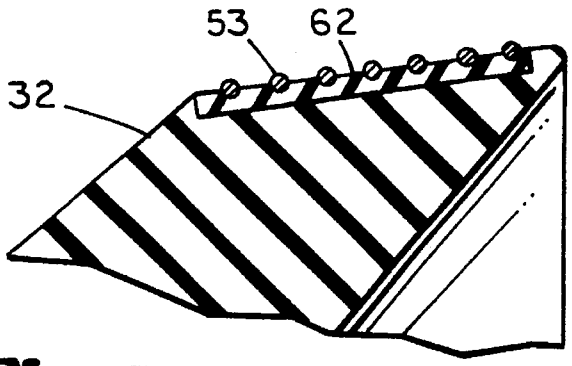
FIG. 5 depicts one preferred embodiment of an abrasive material applied to the front cup, illustrated in a partial sectional view.

In an alternate preferred embodiment, the abrasive may be applied to the pig 10 in a slightly different manner. FIGS. 5 and 5A depict sectional views of a portion of the frustrum 32 and the discs 18 and 20. In this alternate embodiment, the abrasive material is partially impregnated in a premolded matrix or pad 62, which is, in turn, bonded to the peripheral surface 54 of the front cup 14, the peripheral surfaces 56 of the discs 18 and 20 and the leading edge surfaces 58 of the fingers 60*a* and 60*b*. The matrix 62 may be bonded to the pig 10 by an adhesive material or it may be formed integral with the pig 10 during the molding process. Note that no abrasive is applied to the leading edge surface 58 of fingers 60*c–e*, since, as shown in FIG. 7, the trailing disc of any given pair of discs, such as disc 30, does not contact the pipeline 70 during maximum finger deflection.

A number of materials may be suitable for the abrasive material 53. For example, the abrasive material 53 may be garnet, aluminum oxide, or tungsten carbide, or other suitable equivalent materials. The size and dispersion of the abrasive material 53 will depend upon the properties of the coating to be removed.

The loosening of some coatings may be facilitated by the application of a cleaning solvent to the interior surface of a pipeline in advance of the passage of the pig 10. This may be accomplished by jetting a cleaning solvent under pressure from behind the pig 10 to the interior surfaces of a pipeline in front of the pig 10.

Figure 6:
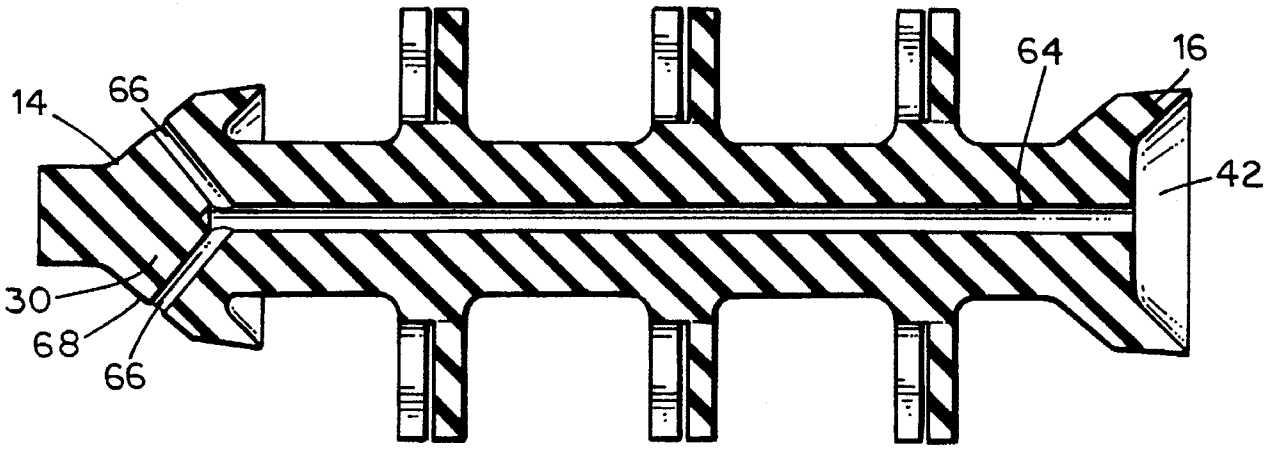
FIG. 6 depicts an alternate preferred embodiment of the pig, including a jetting configuration, illustrated in a sectional view.

FIG. 6 shows a sectional view of an alternate embodiment of the pig 10 configured to provide such a jetting action. The pig 10 includes a main passage 64 which extends longitudinally through the body 12 from the interior frustro-conical surface 42 of the rear cup 16 longitudinally through the body 12 and terminating within the first cup 14. A number of jet conduits 66 extend from the main passage 64 through the front cup 14, venting at the peripheral surface 68 of the frustrum 30. The jet conduits 66 are depicted as being disposed approximately normal to the peripheral surface 68 of the frustrum 30. However, the jet conduits 66 may be junctioned with the main passage 64 at a point closer to the rear cup 16, thereby lengthening the jet conduits 66 and enabling the cleaning solvent to be projected onto the interior surface of a pipeline a farther distance away from the pig 10, if desired. The number and circumferential spacing of the jet conduits 66 is a matter of discretion on the part of the designer.

The operation of the pig 10 is illustrated by reference to FIG. 7, which is a sectional view of the pig 10 translating in a pipeline 70 that has a relatively larger diameter section 72 and a relatively smaller diameter section 74. The direction of travel is indicated by the arrow. As the pig 10 is translating in the relatively larger diameter section 72, the discs 26 and 28 are bent backward due to the friction between the discs 26 and 28 and the interior surface 76 of the relatively larger diameter section 72. In the larger diameter section 72, fluid pressure is exerting a thrust on the pairs of discs that are forming a seal with the interior surface 76. As the discs 18 and 20 encounter the smaller diameter section 74, they begin to bend. At this point, the seal between the discs 18 and 20 and the interior surface 76 may break, and the front cup 14 becomes the primary fluid pressure thrust surface. Upon entering the smaller section 74, the discs 18, 20 and 22, 24 are respectively bent backwards nearly 90°. The gaps 39 between the discs 18 and 20, 22 and 24, and 26 and 28, allow relative shearing movement between the discs 18 and 20, 22 and 24, and 26 and 28. While in the smaller section 74, the back cup 16 stabilizes the body 12 from wobbling, and acts as a thrust surface to aid in moving the pig 10.

Many modifications and variations may be made in the techniques and structures described and illustrated herein without departing from the spirit and scope of the present invention. Accordingly, the techniques and structures described and illustrated herein should be understood to be illustrative only and not limiting upon the scope of the present invention.

For example, the number and relative spacing of the pairs of discs may be varied. Alternatively, for pipelines where there is a particularly large reduction in internal diameter, the discs will have a relatively large diameter, yet the fingers will have to be very narrow ($\theta$ very small), to ensure that the sum of the finger arc lengths is approximately equal to the internal circumference of the smaller diameter pipe section. In such circumstances, there may not be a seal formed by the interaction of the fingers and slots of two adjacent discs because the slots are wider than the fingers. In such situations, it may be desirable to group the discs together in groups of three or more.

In another example, the number and placement of the main passage 64 used to feed cleaning solvent to the jet conduits 66 may be varied.

I claim:

1. A pipeline pig adapted to pass through a pipeline having an internal surface, a first length having a first internal diameter, and a second length having a second internal diameter, comprising:

an elongate elastomeric body having a first end, a second end, and a longitudinal axis;

a first elastomeric cup coupled to said first end;

a second elastomeric cup coupled to said second end, said second cup having a rear surface; and at least one pair of first and second elastomeric discs coupled to said body between said first and second ends;

each of said first and second discs having first radius and a second radius, and a plurality of circumferentially spaced fingers extending radially outward from said first radius to said second radius, each of said fingers having a front surface and an arcuate peripheral surface, said arcuate peripheral surface of each finger having an arc length, said fingers having a first erect position when in said first length of pipeline, and a second bent position when in said second length of pipeline;

said fingers being respectively separated from each other by a plurality of circumferentially spaced slots, said slots extending radially inward from said second radius to said first radius;

for each said pair of discs, said first disc being rotatably positioned relative to said second disc such that said slots of said first disc are aligned with the fingers of said second disc.

2. The pig of claim 1 wherein said body, said cups, and said intermediate discs comprise a unitary cast structure.

3. The pig of claim 1 wherein the sum of said arc lengths is approximately equal to the internal circumference of said second length of pipeline.

4. The pig of claim 1 further comprising an abrasive coupled to said front and arcuate surfaces of each said finger.

5. The pig of claim 4 wherein said abrasive is partially impregnated into said front and arcuate surfaces.

6. The pig of claim 4 wherein said abrasive comprises a pad of abrasive material bonded to said front and arcuate surfaces.

7. The pig of claim 6 wherein said abrasive material is garnet.

8. The pig of claim 4 wherein said abrasive is garnet.

9. The pig of claim 1 wherein twice the length of said second radius is less than or equal to said internal diameter of said second length of pipeline and greater than or equal to said internal diameter of said second length of pipeline minus 0.5 inches.

10. The pig of claim 1 wherein said pig is formed from polyurethane.

11. The pig of claim 10 wherein said pig has a durometer value of between 60 and 80 inclusive.

12. The pig of claim 1 wherein said first cup has a generally conical outer surface, further comprising: a passage extending longitudinally from said rear surface of said second cup to at least one conduit, said at least one conduit extending from said passage to said conical outer surface to permit fluid to be jetted from behind said pig to the internal surface of said pipeline in front of said pig.

13. The pig of claim 12 wherein said passage is disposed longitudinally within said body, and said conduit is disposed within said first cup.

14. The pig of claim 1 wherein said fingers increase in circumferential width between said first radius and said second radius.

15. A unitized construction, non-metallic, pig adapted to pass through a pipeline having an internal surface, a first length having a first internal diameter, and a second length having a second internal diameter, comprising:

an elongate elastomeric body having a first end, a second end, and a longitudinal axis;

a first elastomeric cup being positioned at said first end, said first cup having a conical front surface;

a second elastomeric cup being positioned at said second end, said second cup having a rear surface; and first, second, and third pairs of elastomeric discs being positioned between said first and second ends;

each of said discs having first radius and a second radius, and a plurality of circumferentially spaced fingers extending radially outward from said first to said second radius, each of said fingers having a front surface and an arcuate peripheral surface, said arcuate peripheral surface of each finger having an arc length, each of said fingers having a first width at said first radius and a second and larger width at said second radius, said fingers having a first erect position when in said first length of pipeline, and a second bent position when in said second length of pipeline;

said fingers being respectively separated from each other by a plurality of circumferentially spaced slots, said slots extending radially inward from said second radius to said first radius;

for each of said pair of elastomeric discs, said first of said discs being rotatably positioned relative to said second of said discs such that whereby said slots of said first discs are aligned with the fingers of said second intermediate disc.

16. The pig of claim 15 wherein the sum of said arc lengths is approximately equal to the internal circumference of said second length of pipeline.

17. The pig of claim 15 further comprising an abrasive coupled to said front and arcuate surfaces of each said finger.

18. The pig of claim 17 wherein said abrasive is partially impregnated into said front and arcuate surfaces.

19. The pig of claim 17 wherein said abrasive comprises a pad of abrasive material bonded to said front and arcuate surfaces.

20. The pig of claim 19 wherein said abrasive material is garnet.

21. The pig of claim 17 wherein said abrasive is garnet. garnet.

22. The pig of claim 15 wherein twice the length of said first radius is less than or equal to said internal diameter of said second length of pipeline and greater than or equal to said internal diameter of said second length of pipeline minus 0.5 inches.

23. The pig of claim 15 wherein said pig is formed from polyurethane.

24. The pig of claim 23 wherein said pig has a durometer value of between 60 and 80 inclusive.

25. The pig of claim 15 wherein said first cup has a generally conical outer surface, further comprising: a passage extending longitudinally from said rear surface of said second cup to at least one conduit, said conduit extending to said conical outer surface to permit fluid to be jetted from behind said pig to the internal surface of said pipeline in front of said pig.

26. The pig of claim 25 wherein said passage is disposed longitudinally within said body, and said conduit is disposed within said first cup.

27. The pig of claim 15 wherein said fingers increase in circumferential width between said first radius and said second radius.

* * * * *